US005735331A

United States Patent [19]

Engdahl et al.

[11] Patent Number: 5,735,331

[45] Date of Patent: Apr. 7, 1998

[54] METHOD AND APPARATUS FOR REGULATING THE TEMPERATURE IN A CHEMICAL MELT DISSOLVING TANK

[75] Inventors: Holger Engdahl; Jouni Jäntti, both of Savonlinna, Finland

[73] Assignee: Ahlstrom Machinery Corporation, Helsinki, Finland

[21] Appl. No.: 722,782

[22] Filed: Sep. 27, 1996

[30] Foreign Application Priority Data

Sep. 29, 1995 [FI] Finland ..... 954665

[51] Int. Cl.[6] ..... D21C 11/02

[52] U.S. Cl. ..... 162/30.1; 162/30.11; 162/47; 162/375; 422/234; 422/235; 422/185

[58] Field of Search ..... 162/29, 30.1, 47, 162/375; 422/185, 198, 234, 235

[56] References Cited

U.S. PATENT DOCUMENTS 3,773,918 11/1973 Kohl ..... 48/197 R

*Primary Examiner*—Donald E. Czaja
*Assistant Examiner*—Dean T. Nguyen
*Attorney, Agent, or Firm*—Nixon & Vanderhye P.C.

[57] ABSTRACT

A method of regulating the temperature in a chemical melt dissolving tank, where chemical melt produced in combustion of spent liquor of a cellulose pulp mill is dissolved in liquid, producing green liquor, provides excellent heat economy, while minimizing the amount of liquid needed to dissolve the melt to produce green liquor at a temperature below boiling. Green liquor produced in the dissolving tank is expanded (and thereby cooled) in a vacuum tank, and a least a significant part of the cooled liquor is returned to the dissolving tank, for regulating the temperature in the tank. The heat energy contained in the generated expansion steam may be used in many different ways, for example, for indirectly heating (e.g. in a heat exchanger acting as a condenser) water or other liquid to a sufficiently high temperature so that the liquid is useful elsewhere in the pulp mill. The vacuum tank may be positioned above dissolving the tank to receive liquor directly from it, and the condenser may be positioned in it to return condensate directly to the dissolving tank. Alternatively the vacuum tank and condenser may be remote from the dissolving tank and connected to the dissolving tank by conduits.

20 Claims, 1 Drawing Sheet

METHOD AND APPARATUS FOR REGULATING THE TEMPERATURE IN A CHEMICAL MELT DISSOLVING TANK

BACKGROUND AND SUMMARY OF THE INVENTION

The present invention relates to a method and apparatus for regulating the temperature in a chemical melt dissolving tank, where chemical melt produced in the combustion of spent liquor (e.g. black liquor) from a cellulose pulp mill is dissolved to produce green liquor.

An important piece of equipment in the chemical recovery circulation of sulphate and other sodium-based cellulose pulp manufacturing processes is a recovery boiler, such as a soda recovery boiler. Spent liquor containing useful chemicals is fed to the recovery boiler and combusted, producing energy and putting the chemicals into a form suitable for recovery. The most important of such chemicals of the sulphate process are sodium and sulphur. Organic substances dissolved in the spent liquor during cooking are what actually combust in the recovery boiler thereby generating heat, which is then utilized to convert inorganic substances of the spent liquor back into chemicals usable in cooking and to generate steam. Inorganic matter contained in the spent liquor melts at the high temperature of the boiler and then flows as a chemical melt down to the bottom of the recovery boiler. The recovery boiler also serves as a steam boiler, in which heat released during combustion is recovered as steam, primarily by water tubes lining the boiler walls, and as high-pressure superheated steam, by superheaters positioned in the upper section of the boiler.

From the bottom of the boiler, the chemical melt is conveyed through cooled melt spouts to a dissolving tank, in which it is dissolved in either water or weak white liquor, to produce green liquor. The main components of the melt, and therefore also of the green liquor, in the sulphate process are sodium sulphide and sodium carbonate. The green liquor is further conventionally causticized by calcium oxide into white liquor.

The melt flows from the bottom of the boiler to the dissolving tank at a temperature of about 780°–900° C. The temperature of the solution (liquor) in the dissolving tank is about 85°–100° C. In practice, the temperature in the dissolving tank must not be allowed to rise higher than this because it will lead to uncontrolled boiling of the liquor in the tank. Such uncontrolled boiling causes dangerous splashing in the surroundings, vibrations or other equipment disturbances caused by melt and water coming into contact with each other, and chemical losses because chemicals are carried away by exhaust steam produced during dissolving.

The temperature of the melt dissolving process is typically primarily controlled by regulating the temperature and/or the amount of the liquid used to dissolve the melt. The steam released from the dissolving tank carries energy away. The liquid most commonly used for dissolving is weak white liquor returned from causticizing, and often its temperature is already quite high, leading one to believe that it should be possible to cool this liquid prior to feeding it into the dissolving tank, so as to enable temperature regulation in the dissolving tank. In practice, however, it has been difficult to cool this liquid because compounds having low solubilities in weak liquor have been deposited on the heat transfer surfaces of the heat exchanger used for this purpose. Even if such cooling were successful, however, it would result in a large amount of water of 30°–40° C.; there is hardly any use for water of that temperature in a pulp mill.

Better heat economy is received by transferring heat by a heat exchanger, directly from green liquor produced in the dissolving tank to water. In this way it is possible to obtain water of about 80° C. This procedure is, however, prevented in practice because of heavy deposition of salts, present in the green liquor, onto cooling surfaces, which results in the heat transfer surfaces of the heat exchanger soon becoming clogged. This phenomenon has prevented cooling of green liquor directly with a heat exchanger.

It has also been suggest to lower the temperature of the green lo liquor coming from the dissolving tank and entering the causticizing process by vacuum cooling, so that the liquor does not come into contact with heat transfer surfaces. Cooling of green liquor is thereby intended to prevent boiling in lime slaking in the causticizing plant. However this does not help control of the temperature in the dissolving tank.

A need exists in the art for a method of regulating the temperature in the dissolving tank that is straightforward in operation and feasible in terms of energy economy. In the prior art, boiling in the dissolving tank is prevented by feeding enough weak liquor into the tank to control the temperature so that it is below boiling. This has resulted in the weakening of the concentration of many liquors in the entire pulp mill, so that the concentrations are lower than optimum to practice some processes. In some cases, as much as a third of water has been unnecessarily circulated along with white liquor to the cooking plant and via the chemical circulation loop further in the process.

Today, the mills strive to completely close material circulation systems. Consequently, the pulp mill liquors need to be stronger than before. However, this renders energy control ever more difficult with the methods presently known for dissolving green liquor and controlling temperature in the dissolving tank.

The present invention seeks to minimize or eliminate the above-mentioned drawbacks caused by prior art methods of treating green liquor and, especially, to offer means for both minimizing the amount of liquid used for dissolving chemical melt and for improving the recovery of heat energy released in dissolving. In order to achieve this objective it is a feature of the method of the invention to expand (and thereby cool) the green liquor produced in the dissolving tank, and the cooled green liquor is returned to the dissolving tank to regulate the temperature therein.

In the method according to the invention, heat is transferred from green liquor into a heat transfer medium, such as water, by a heat exchanger, but the heat exchanger is used in such a way that the green liquor is not in direct contact with heat transfer surfaces. Heat is transferred by first allowing the green liquor to expand to a slight vacuum. The green liquor is preferably expanded at a pressure of below 0.7 bar absolute, preferably between about 0.4–0.6 bar absolute. Thereafter, the product steam is condensed. When condensed, the steam releases heat directly into water, or indirectly into water or some other medium, so that pure condensate is formed on the heat transfer surface, which condensate does not cause clogging of the heat exchanger. The condensate produced may simply be returned to the dissolving tank, and/or used elsewhere as hot water. The cooled green liquor is returned to the dissolving tank cools the tank. Thus, the amount of transferred heat is not dependent on the liquid flow of the process, but a desired amount of heat energy may be removed from the dissolving tank and hot water made therefrom, or the heat thereof otherwise utilized. Large quantities of hot wash water is needed, e.g., in the bleach plant of the pulp mill, for pulp washing, therefore the water produced is readily used in the mill.

There are numerous other uses for the energy removed from the dissolving tank. Commonly hot water is produced from cold or warm water by utilizing the present technology and by employing higher-degree energy, such as fuel, steam etc. One of the ways of using the energy in steam produced from heat from the dissolving tank is to use the steam as is, or in a compressed form, in an evaporators. There are evaporators for several purposes in the pulp mill, for evaporating water from various solutions. Thus, steam received from cooling of green liquor may be used to replace other steam, which other steam is typically of higher "quality" and may be used for more important purposes, such as production of electric power, or for stripping of condensates.

Steam obtained by the cooling of green liquor from the dissolving tank may also be used for indirect heating of the combustion air of a soda recovery boiler or other combustion equipment. In this case, the energy economy of said combustion equipment is improved. For heating of rooms, energy received as hot water or air from green liquor, in accordance with the invention, is also more advantageous than use of expensive energies. The temperature of the hot water received in accordance with the method described herein is high enough so that there are many uses for that water, for example, e.g. for space heating, or in various processes within the pulp mill.

By using the inventive method, almost all excessive dissolving energy may be recovered at a temperature of about 65° to 80° C., depending on the application and dimensioning of the heat exchanger. By using prior art methods, the energy is recovered, at its best, at a temperature of about 30° to 50° C., while a considerable part thereof is wasted along with exhaust steam.

The method according to the invention is flexible because it may be practiced so that only the amount of green liquor that is taken from the dissolving tank is that which has an amount of heat energy sufficient for some specific purpose. In this case, the temperature of the dissolving tank is also regulated with some other method known per se, such as by introducing dissolving liquid, e.g. weak white liquor, at a suitable temperature and in an appropriate amount into the dissolving tank so that the temperature of the dissolving tank is maintained at a desired level. That is, the temperature of the dissolving tank is controlled by regulating (individually or in synchronism) both the flow of the dissolving liquor and the expansion of the green liquor.

According to one aspect of the present invention a method of regulating the temperature in a dissolving tank for a chemical melt, produced by combustion of spent liquor in a cellulose pulp mill, is provided. The method comprising the steps of: (a) dissolving the melt in liquid in the dissolving tank to produce green liquor; (b) expanding at least part of green liquor produced in the dissolving tank to cool the green liquor; and (c) returning at least a significant portion of the cooled, expanded, green liquor to the dissolving tank to regulate the temperature in the dissolving tank. [A "significant portion" is at least 10%, and preferably at least a majority.]

In the practice of the method of the invention preferably steps (a)–(c) are practiced to maintain the temperature in the dissolving tank below about 100° C. Also, step (b) is preferably practiced to expand the green liquor at a pressure of below 0.7 bar absolute (e.g. between 0.4–0.6 bar absolute). There is also preferably the further step (d) of regulating the temperature in the dissolving tank in another manner in addition to practicing steps (a)–(c), in which case steps (a)–(d) may be practiced so that the temperature of the green liquor used in the practice of step (b) is about 90°–100° C., and step (b) practiced to produce steam having a temperature of about 84°–90° C.; and step (b) practiced so as to remove only enough green liquor to indirectly heat a predetermined amount of fluid to a predetermined temperature.

Step (b) is, or course, practiced to produce expansion steam, and there is preferably the further step (e) of using the expansion steam to directly or indirectly heat another fluid or fluent material (e. g. wood chips, or a slurry in a pulp mill). Step (e) may be practiced to produce a condensate; and the method may comprise the further step (f) of returning at least a majority of the condensate to green liquor. Step (f) may be practiced so as to return at least a significant part [i. e. at least 10%] of the green liquor to which condensate has been returned to the dissolving tank, or to pass at least a majority of the condensate to use remote from the dissolving tank.

Steps (a)–(c) may practiced so that the temperature of the green liquor used in the practice of step (b) is about 90°–100° C., and wherein step (b) is practiced to produce steam having a temperature of about 84°–90° C. There may also be the further step of compressing the steam produced from step (b).

According to another aspect of the present invention, a chemical melt dissolving tank system is provided comprising the following components: a chemical melt dissolving tank; means for feeding chemical melt to the dissolving tank; means for providing dissolving liquid in the dissolving tank to dissolve the chemical melt to produce liquor; a vacuum tank connected to the dissolving tank to receive liquor from the dissolving tank, expand the liquor and thereby cool the liquor, and to produce expansion steam; means for returning cooled, expanded liquor to the dissolving tank, to regulate the temperature in the dissolving tank; and a condenser for condensing the expansion steam.

The vacuum tank may be positioned above the dissolving tank so that a vacuum prevailing in the vacuum tank draws liquor into the vacuum tank; for example the vacuum tank may be positioned so that liquor from the dissolving tank rises into the vacuum tank and cooled liquor is returned to the dissolving tank without directly pumping the liquor. Typically vacuum tank includes a jacket, and the dissolving tank has a level of liquor therein, and preferably the vacuum tank jacket extends below the level of liquor in the dissolving tank. The condenser may comprise an indirect heat exchanger disposed within the vacuum tank.

Alternatively the vacuum tank may be remote from the dissolving tank and is connected thereto by a conduit having a valve controlled in response to the level of liquor in the vacuum tank; and wherein the vacuum tank is connected by a steam conduit to the condenser, the condenser being remote from the vacuum tank.

The means for feeding chemical melt to the dissolving tank includes a recovery boiler for a cellulose pulp mill, and a conduit between the recovery boiler and the dissolving tank.

It is the primary object of the present invention to provide an efficient way of regulating the temperature in a green liquor dissolving tank, with excellent heat economy, and while minimizing the amount of liquid needed to dissolve the melt to produce green liquor at a temperature below boiling. This and other objects of the invention will become clear from an inspection of the detailed description of the invention, and from the appended claims.

DETAILED DESCRIPTION OF THE DRAWINGS

Figure 1:
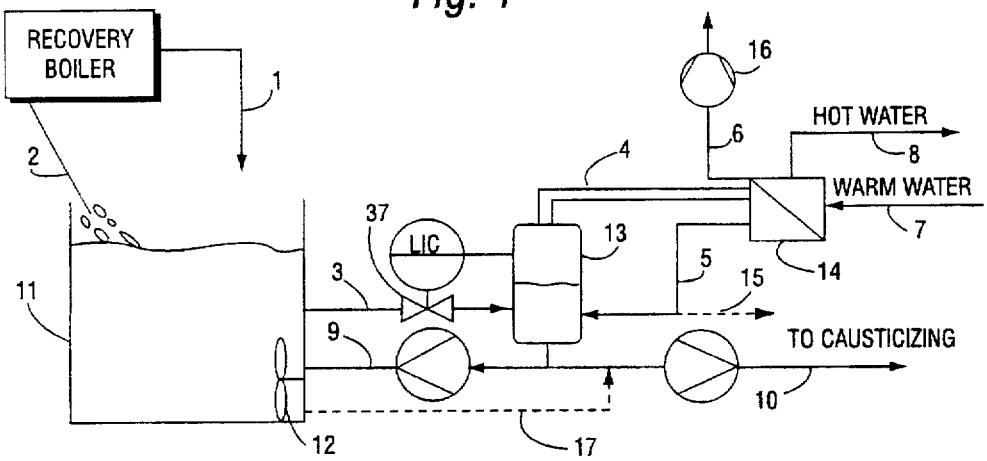
FIG. 1 is a schematic illustration of a preferred embodiment for implementing the method of the invention.

In the embodiment of FIG. 1, melt 2 produced in the recovery boiler is passed to a dissolving tank 11. Dissolving liquid, such as weak liquor 1 from causticizing, is also introduced into the tank 11. In the dissolving tank 11, weak liquor and melt are efficiently mixed by a mixer 12, so that the melt is dissolved in the weak liquor. Green liquor 3 produced in the dissolving tank 11 and having a temperature of about 90° to 95° C. is passed to a vacuum tank 13, where a vacuum (of about 400–600 mbar absolute) corresponding to a temperature of about 80° to 85° C. is maintained.

In the vacuum tank 13, the green liquor expands, at the same time vaporizing and cooling to a temperature of about 84° to 89° C. The level of green liquor in the tank 13 is preferably controlled by a conventional level controlled valve 37. Steam in conduit 4 at a temperature of about 80° to 85° C. is passed to a heat exchanger (condenser) 14 where the heat transferred (preferably indirectly) from the green liquor to the steam is passed to water 7 or other medium, which is capable of utilizing heat recovered from the green liquor. For example water in line 8 at a temperature of 75° to 80° C. is obtained. The expansion steam produced may be advantageously compressed to further raise the condensing temperature, if desired.

The hot water 8 discharged from the heat exchanger 14 is further passed to the locations in the pulp mill where it will be used, such as have been described above, and condensate 5 produced from the steam is returned in cooled green liquor to a dissolving tank 11, or it is removed form the process via a conduit 15. Uncondensed gases 6 gradually gathered in heat exchanger 14 are drawn out by a vacuum pump 16. Cooled green liquor in conduit 9 is returned to dissolving tank 11 to regulate the temperature, alone, or in conjunction with active control of the amount and temperature of dissolving liquid introduced at 1.

Green liquor in conduit 10 needed for causticizing is taken from the cooled green liquor being returned to the dissolving tank 11 from the vacuum tank 13. The flows in lines 9, 10 may be split as needed for temperature control and for white liquor production (e.g. about 50–50). It is advantageous to return the cooled green liquor to the suction side of the mixer propeller 12 of the dissolving tank 11, as schematically illustrated in FIG. 1.

The temperature of the green liquor in line 10 which enters the causticizing process may also be regulated by taking a portion of the liquor from the dissolving tank 11 through line 17, and adding it to the volume of flow in line 10.

Figure 2:
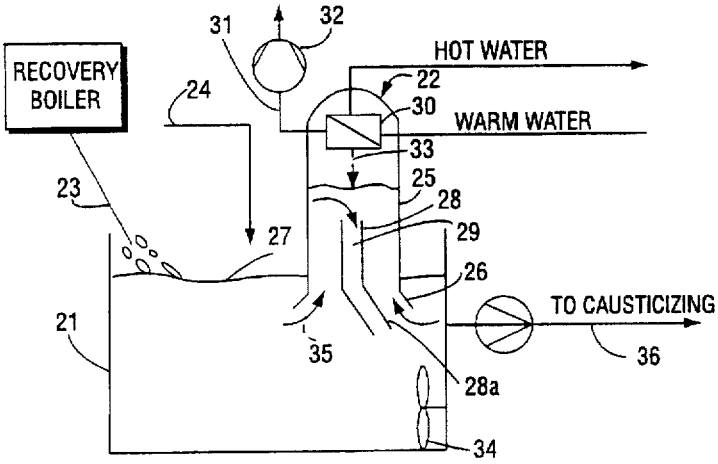
FIG. 2 is a schematic illustration of a second preferred embodiment for implementing the method of the invention.

In the embodiment shown in FIG. 2, the vacuum tank 22 is disposed above the dissolving tank 21. Melt 23 and weak liquor or some other dissolving liquor 24 is introduced into the dissolving tank 21 to produce green liquor. The vacuum tank 22 comprises a jacket 25, the bottom edge 26 of which extends below the liquid level 27 prevailing in the dissolving tank 21. The vacuum prevailing in the vacuum tank 22 draws green liquor into the vacuum tank 22, where the liquor expands and then returns to the dissolving tank 21, drawn by natural circulation.

Figure 3:
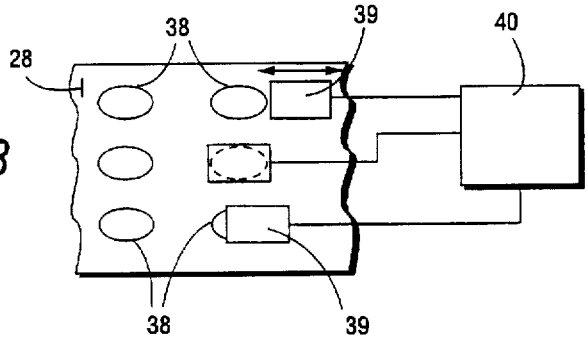
FIG. 3 is a schematic detail view showing the openings in the partition wall of the system of FIG. 2.

The portion of the vacuum tank jacket 25 filled with green liquor is divided by a partition wall 28 into different passages, that is so that hot liquor to be cooled and cooled liquor returning to the dissolving tank 21 each have a passage of their own. In FIG. 2 the liquor returns to the dissolving tank 21 via a pipe-type passage 29. Partition wall 28 is preferably provided with perforations or openings (see perforations 38 in FIG. 3), which may be either totally or partly selectively closed, e.g. using an opening 38 closing element 39, controlled by a powered controller 20, as schematically illustrated in FIG. 3. Any conventional suitable structures, such as fluid cylinders, solenoids, or a wide variety of mechanically or electrically powered devices may be used for this purpose.

Control of the flow through the partition wall 28 is desirable because the temperature of the green liquor may slightly fluctuate in practice, which means that the pressure in the vacuum tank 22 varies, causing variations to the liquor level of the tank 22 as well. To ensure the best possible operation of the green liquor circulation, which is partly or totally based on natural circulation, the green liquor circulation has to be maintained at a predetermined level, hence the desirability of an adjustment mechanism such as schematically (only) illustrated in FIG. 3.

In the FIG. 2 embodiment, the steam generated as a result of expansion of green liquor is condensed in a heat exchanger (condenser) 30 positioned in the upper section of the vacuum tank 22. Uncondensed gases 31 are drawn by vacuum pump 32 and expelled from the tank 22, maintaining a vacuum therein (e.g. below 0.7 bar absolute, preferably about 0.4–0.6 bar absolute). The condensate 33 produced is returned to the green liquor. The condenser 30 may be positioned outside the vacuum tank jacket 25 rather than within it, as illustrated in FIG. 2.

Passageway 29 in the vacuum tank 22 is preferably provided with an extension portion 29*a* through which cooled green liquor is returned to the suction side of the conventional mixer 34 of the dissolving tank 21. The liquor to be cooled (denoted by arrows 35) may also be taken to the vacuum tank 22, by using the dynamic pressure of the pressure side of the mixer 34. From the dissolving tank 21 the green liquor in line 36 is pumped or otherwise conveyed to the causticizing process.

Green liquor may also be cooled so that only the amount of energy needed for some specific purpose is removed from the green liquor by flashing. In this case, temperature regulation in the dissolving tank (11, 21) may then be effected using conventional techniques such as by controlling the volume of green liquor removed from the dissolving tank (11, 21), and by controlling the volume and/or temperature of the weak (dissolving) liquor to replace the removed volume of green liquor.

By practicing the present invention it is possible for the first time to recover excessive heat energy from the melt dissolving tank in a reliable manner, so that other operation of the primary process, i.e., production of green liquor, is not directly influenced. Reliability in operation has been improved, in comparison with prior art cooling methods, by replacing direct heat exchangers [which are intended for green liquor or weak white liquor and which are susceptible to clogging] with vacuum expansion, so that hot green liquor releases its excessive heat directly. It is also a characteristic feature of the invention that the steam produced is as substantially as hot as the cooled green liquor, i.e., clearly hotter than, e.g., corresponding weak white liquor, so that the energy content of the steam produced may be utilized at a higher temperature than what can be obtained from weak liquor. For most uses of the steam this is a significant advantage.

The present invention thus also allows and provides the use of highly concentrated liquors, even liquors over saturated with sodium sulphate, so that the production of particularly strong liquors is easier than in the prior art.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A method of regulating the temperature in a dissolving tank for a chemical melt produced by combustion of spent liquor in a cellulose pulp mill, said method comprising the steps of:

(a) dissolving the melt in liquid in the dissolving tank to produce green liquor;

(b) expanding at least part of green liquor produced in the dissolving tank to cool the green liquor; and (c) returning at least a significant portion of the cooled, expanded, green liquor to the dissolving tank to regulate the temperature in the dissolving tank.

2. A method as recited in claim 1 wherein steps (a)–(c) are practiced to maintain the temperature in the dissolving tank below about 100° C., and are the only active steps for regulating the temperature in the dissolving tank.

3. A method as recited in claim 1 wherein step (b) is practiced to expand the green liquor at a pressure of below 0.7 bar absolute.

4. A method as recited in claim 3 wherein steps (a)–(c) are practiced so that the temperature of the green liquor used in the practice of step (b) is about 90°–100° C., and wherein step (b) is practiced to produce steam having a temperature of about 84°–90° C.

5. A method as recited in claim 1 comprising the further step (d) of regulating the temperature in the dissolving tank, in addition to practicing steps (a)–(c), by controlling the amount and temperature of the liquid used to dissolve the melt in step (a).

6. A method as recited in claim 5 wherein steps (a)–(d) are practiced so that the temperature of the green liquor used in the practice of step (b) is about 90°–100° C., and wherein step (b) is practiced to produce steam having a temperature of about 84°–90° C.

7. A method as recited in claim 5 wherein step (b) is practiced so as to remove only enough green liquor to indirectly heat a predetermined amount of fluid to a predetermined temperature.

8. A method as recited in claim 1 wherein step (b) is practiced to produce expansion steam, and comprising the further step (e) of using the expansion steam to directly or indirectly heat another fluid or fluent material.

9. A method as recited in claim 8 wherein step (e) is practiced to produce a condensate; and comprising the further step (f) of returning at least a majority of the condensate to green liquor.

10. A method as recited in claim, 9 wherein step (f) is practiced so as to return at least a significant part of the green liquor to which condensate has been returned to the dissolving tank.

11. A method as recited in claim 8 wherein step (e) is practiced to produce a condensate; and comprising the further step (f) of passing at least a majority of the condensate to use remote from the dissolving tank.

12. A method as recited in claim 1 wherein steps (a)–(c) are practiced so that the temperature of the green liquor used in the practice of step (b) is about 90°–100° C., and wherein step (b) is practiced to produce steam having a temperature of about 84°–90° C.

13. A method as recited in claim 1 wherein step (b) is practiced to produce steam, and comprising the further step of compressing the steam.

14. A chemical melt dissolving tank system, comprising:

a chemical melt dissolving tank;

means for feeding chemical melt to said dissolving tank;

means for providing dissolving liquid in said dissolving tank to dissolve the chemical melt to produce liquor;

a vacuum tank connected to said dissolving tank to receive liquor from said dissolving tank, expand the liquor and thereby cool the liquor, and to produce expansion steam;

means for returning cooled, expanded liquor to the dissolving tank, to regulate the temperature in the dissolving tank; and a condenser for condensing the expansion steam.

15. A system as recited in claim 14 wherein said vacuum tank is positioned above said dissolving tank so that a vacuum prevailing in said vacuum tank draws liquor into said vacuum tank.

16. A system as recited in claim 15 wherein said vacuum tank is positioned so that liquor from said dissolving tank rises into said vacuum tank and cooled liquor is returned to said dissolving tank without directly pumping the liquor.

17. A system as recited in claim 15 wherein said vacuum tank includes a jacket, and wherein said dissolving tank has a level of liquor therein; and wherein said vacuum tank jacket extends below said level of liquor in said dissolving tank.

18. A system as recited in claim 15 wherein said condenser comprises an indirect heat exchanger disposed within said vacuum tank.

19. A system as recited in claim 14 wherein said vacuum tank is remote from said dissolving tank and is connected thereto by a conduit having a valve controlled in response to the level of liquor in said vacuum tank; and wherein said vacuum tank is connected by a steam conduit to said condenser, said condenser being remote from said vacuum tank.

20. A system as recited in claim 14 wherein said means for feeding chemical melt to said dissolving tank includes a recovery boiler for a cellulose pulp mill, and a conduit between said recovery boiler and said dissolving tank.

* * * * *